United States Patent [19]

Rooymans

[11] 4,162,102

[45] Jul. 24, 1979

[54] METHOD AND DEVICE FOR LOOSENING STONY SOIL

[75] Inventor: Joannes A. Rooymans, Muiderberg, Netherlands

[73] Assignee: Ballast-Nedam Groep N.V., Amstelveen, Netherlands

[21] Appl. No.: 798,674

[22] Filed: May 19, 1977

[30] Foreign Application Priority Data

May 26, 1976 [NL] Netherlands ..... 7605721

[51] Int. Cl.[2] ..... E02F 5/04

[52] U.S. Cl. ..... 299/10; 37/81; 299/39; 299/87; 404/127; 172/108

[58] Field of Search ..... 299/87, 40, 39, 10; 37/193, 81, 82; 61/72.5, 72.6; 172/108

[56] References Cited

U.S. PATENT DOCUMENTS

| | | | |
|---|---|---|---|
| 1,071,477 | 8/1913 | Stowe | 37/81 |
| 3,039,208 | 6/1962 | Oglesby et al. | 37/81 |
| 3,714,990 | 2/1973 | Tomik | 37/81 X |
| 3,896,570 | 7/1975 | McMurray | 37/81 |
| 3,905,200 | 10/1975 | Ylinen | 37/193 |

FOREIGN PATENT DOCUMENTS

| | | | |
|---|---|---|---|
| 155459 | 10/1953 | Sweden | 37/81 |

*Primary Examiner*—William Pate, III

[57] ABSTRACT

A method for loosening stony soil by means of a rotating cutting head fastened to the rear of a tractor and having cutting members to be drawn through the soil and being mounted according to a helical line.

Stony soil can be readily loosened to the desired depth because the cutting head can be kept at an acute angle to the direction of movement. So the cutting head is drawn in a stable manner in the direction to the tractor against the stone surface concerned and penetrates the stony soil like a plough, the soil above the cutting head being torn up upwardly.

8 Claims, 5 Drawing Figures

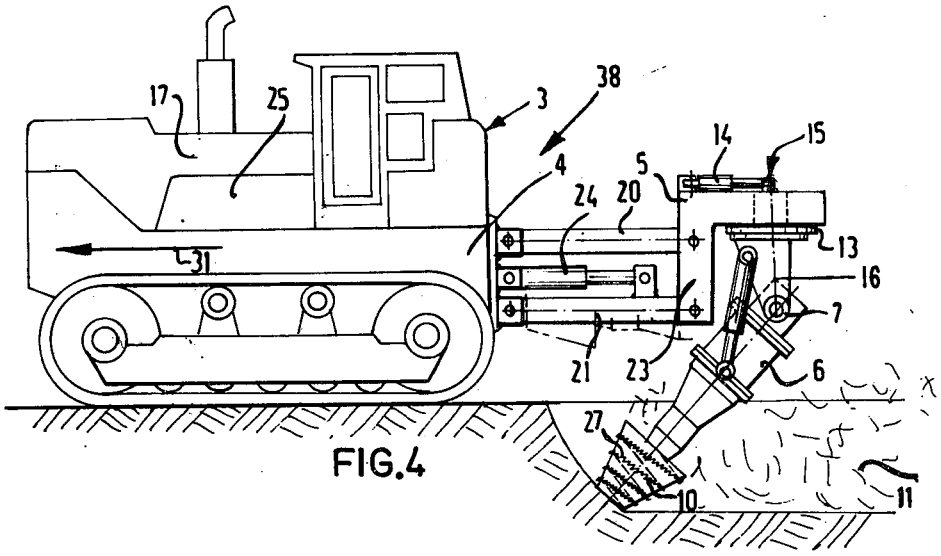
FIG.4
FIG.5
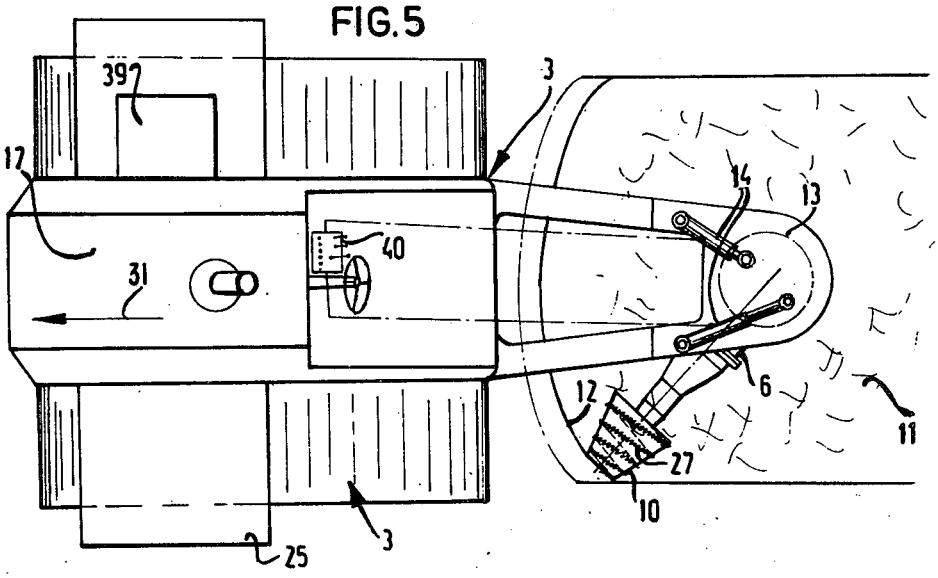

METHOD AND DEVICE FOR LOOSENING STONY SOIL

The invention relates to a method of loosening stony soil, for example, rocky soil, in a groove to be excavated in a later stage by drawing a plurality of cutting members attached to the rear of a tractor and being held at a depth beneath the ground surface in the soil along the trajectory of the groove, in which a plurality of cutting members arranged along at least one helical line is rotated about the axis of the helical line.

Such a method is known from British patent specification No. 1,038,984. In this known method the helical line of the cutting members arranged around a cylindrical surface is held in a vertical position. This method may be appropriate for kinds of stones having a hardness of 100 kgs/cm$^2$, but it is not suitable for working stones of materially higher hardness. If in carrying out the known method rocks are struck, the helical series of cutting members does not remain in stable contact with the surface to be worked. Due to vibrations of the cutting head holding the cutting members the tines will break off or be exposed to excessive wear.

The invention provides a method by which stony soil can be readily loosened to the desired depth because the axis of the helical line is at an acute angle to the direction of movement during operation.

In this method the cutting head with the cutting members is drawn in a stable manner in the direction to the tractor against the stone surface concerned and the external reactive forces tending to push the cutting head out of the adjusted position are overcome by the tractive force of the tractor. Moreover, the cutting head penetrates the stony soil like a plough, the soil above the cutting head being torn up upwardly.

It should be noted that in subaqueous dredging by means of a cutting head it is generally known to direct the axis of a series of cutting members arranged along a helical line on a cutting head at an acute angle to the horizontal to the soil. In this case the cutting head is moved by a lateral tractive force along a freed slope.

The invention furthermore provides a device for carrying out the method embodying the invention, comprising a tractor, a carrier attached to the rear side of the tractor and being adjustable to depth by setting means and a tool having a plurality of cutting members and being supported by said carrier, said tool being formed by a cutting head adapted to rotate about an axis, the plurality of cutting members being mounted around the axis along at least one helical line, said device being characterized by setting means for causing the rotary axis of the cutting head to be at an acute angle to the direction of movement.

It should be noted that it is known per se to dig grooves with the aid of a tractor-drawn ditch dredger, for example, from Dutch patent specification No. 29,450 or French patent specification No. 1,501,207. These two publications relate to digging wheels to be drawn by a tractor, comprising means for digging up and conducting away the earth loosened by the cutting means. Neither of these two devices is suitable for loosening stony soil to be dug up in a later stage with the aid of conventional excavating means.

In order to ensure an optimum cutting effect of the drilling means in dependence upon the nature of the soil, driving means are provided for turning the carrier, in operation, about a horizontal axis.

A further development permits of loosening, in a single run, a groove having a width exceeding that of the drilling head and is characterized by driving means for turning the carrier, in operation, about a vertical axis.

The aforesaid and further features of the invention will be described more fully with reference to the drawing.

In the drawing there show schematically:

Figure 2:
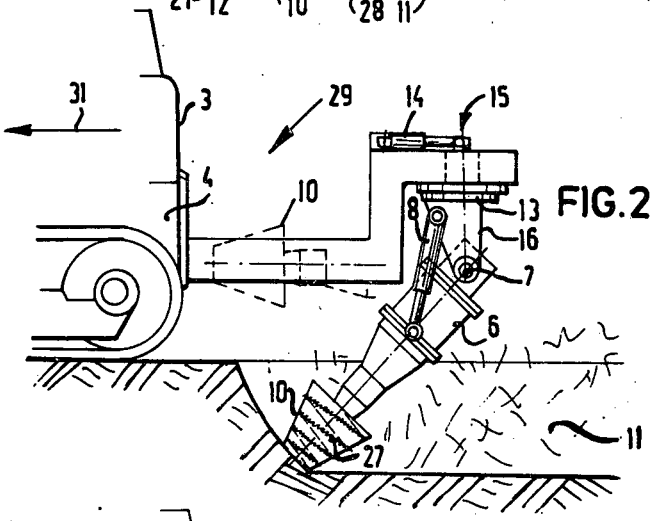
FIG. 2 is a further development of the device in accordance with the invention.
Figure 3:
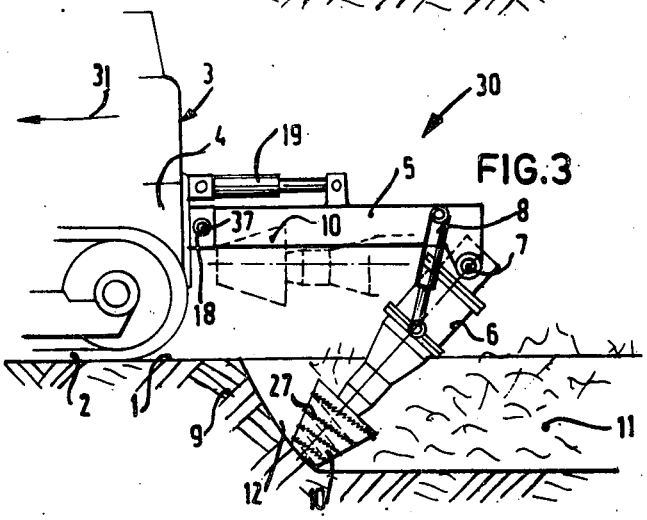

FIGS. 3 and 4 side elevations of further embodiments of the device in accordance with the invention, and FIG. 5 is a plan view of the device shown in FIG. 2.

Figure 1:
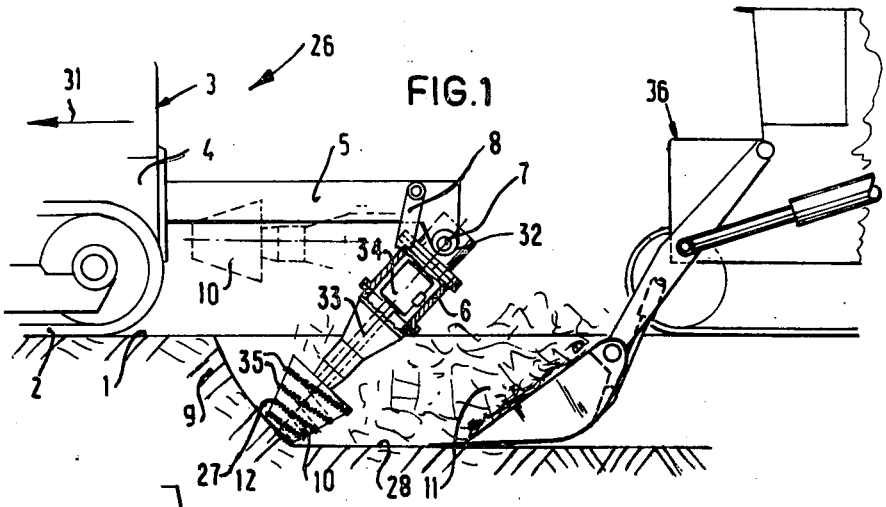
FIG. 1 is a side elevation of a device in accordance with the invention.

The device 26 shown in FIG. 1 for carrying out the method in accordance with the invention comprises a tractor 3 having a frame 4 moving by means of a caterpillar drive 2 in the direction of the arrow 31 across the ground surface 1, a framework 5 rigidly secured to the frame 4 on the rear side of the tractor 3, a carrier 6 pivoted to the framework 5 and being adjustable to depth about a horizontal axis 32 of a hinge 7 by means of a hydraulic worm 8 and a tool formed by a cutting head 10, supported by a carrier 6 and being adapted to rotate about an axis 33 with respect to said carrier 6 and being driven by means of an electric motor 34, said head being provided with a plurality of cutting members 27, for example, chisels, along a plurality of tapering helices 35 around the axis 33.

When the method according to the invention is carried into effect the tractor 3 of the device 26 rides in the direction of the arrow 31 across the ground surface 1 and draws with great force the cutting head 10 with the cutting members 27 held beneath the ground surface 1 along the trajectory of the groove 28 across the soil 9, whilst the cutting head 10 is rotatably driven. Thus the stony soil 9 is loosened. The loosened earth 11 is scooped out of the groove 28 in a later stage, for example, with the aid of a shovelling tool 36 from the groove 28. If the soil 9 is very hard, the cutting head 10 can be moved to and fro along the slope 12 by pivoting the carrier 6 so that the soil 9 is satisfactorily loosened. The broken lines illustrate the cutting head 10 in its elevated position.

In the device 29 shown in FIGS. 2 and 5 the carrier 6, as compared with that of the device 26, is, in addition, adjustable about a vertical axis 15 by means of a turntable 13, which can be turned by means of hydraulic worms 14. To the turntable 13 is fastened a stool 16, to which the carrier 6 is pivotally fastened by the hinge 7.

The device 30 of FIG. 3 is distinguished from the device 26 in that the framework 5 is connected at the hinge point 18 with the frame 4 so as to be pivotable about a horizontal axis 37 in order to cause the cutting head 10 to perform a vertical movement without variation of the angle between the carrier 6 and the ground surface 1 by means of the hydraulic worms 19.

The framework 5 of the device 38 of FIG. 4, which is suspended to the frame 4 by means of a parallel rod system 20, 21 and a hydraulic worm 24, has furthermore a turntable 13 with a stool 16.

The combustion engine 17 of the tractor 3 drives not only the caterpillar drive 2 but also an electric generator 25, which, in turn, drives the electric motor 34 and a hydraulic pump 39 for swinging the turntable 13 and hence the cutting head 10 to and fro along the slope 12 via a control-member 40 by means of worms 14.

What I claim is:

1. The method of excavating a trench in stony soil, which comprises the steps of:

(a) providing a cutting head having a body which is symmetrical about an axis of rotation and which has a forward end face and a side surface behind said face, and at least one helical row of cutters projecting outwardly from said side surface so as likewise to be disposed behind said face;

(b) positioning said cutting head below ground surface such that said side surface as well as said axis of rotation is inclined downwardly and forwardly at an acute angle with respect to the horizontal whereby during subsequent forward motion of the cutting head only said face contacts stony soil which is undisturbed;

(c) plowing said cutting head forwardly along a horizontal path through the soil so that said face breaks up the undisturbed soil which it contacts ahead of said cutters, and simultaneously rotating said cutting head about said axis whereby said cutters further break up the soil and mound it upwardly in loosened state within a trench defined along the plowing path of the cutting head;

subsequently removing the loosened soil from within the trench;

and including, during step (c), the step of swinging said cutting head back and forth in a horizontal plane whereby the trench which is formed is wider than said cutting head.

2. The method as defined in claim 1 wherein step (b) is effected by swinging said cutting head downwardly while said cutting head is rotating, thereby to cut downwardly into the ground surface until the position of step (b) is reached.

3. The method of excavating a trench in stony soil, which comprises the steps of:

(a) providing a cutting head having a body which is symmetrical about an axis of rotation and which has a forward end face and a side surface behind said face, and at least one helical row of cutters projecting outwardly from said side surface so as likewise to be disposed behind said face;

(b) positioning said cutting head below ground surface such that said side surface as well as said axis of rotation is inclined downwardly and forwardly at an acute angle with respect to the horizontal whereby during subsequent forward motion of the cutting head only said face contacts stony soil which is undisturbed;

(c) plowing said cutting head forwardly along a horizontal path through the soil so that said face breaks up the undisturbed soil which it contacts ahead of said cutters; and simultaneously rotating said cutting head about said axis whereby said cutters further break up the soil and mound it upwardly in loosened state within a trench defined along the plowing path of the cutting head;

(d) subsequently removing the loosened soil from within the trench;

step (b) being effected by swinging said cutting head downwardly while said cutting head is rotating, thereby to cut downwardly into the ground surface until the position of step (b) is reached.

4. Apparatus for forming a trench in stony soil within which the stony soil has been loosened for ease of subsequent removal, comprising in combination:

a rigid frame adapted to be rigidly attached to a powered vehicle;

an elongate carrier pivotally mounted at its rearward end on said frame about a horizontal, transverse axis and means for swinging said carrier between a substantially horizontal, forwardly projecting position disposed above the ground surface and a forwardly and downwardly inclined position in which the forward end of the carrier is below the ground surface;

a cutting head rotatably mounted at the forward end of said carrier about the longitudinal axis of the carrier, said cutting head presenting a forward end face and a side surface behind said face, and at least one helical row of cutters projecting from said side surface, said side surface being disposed at an acute angle with the horizontal when the carrier is disposed in said forwardly and downwardly inclined position thereof whereby said forward end face of the cutting head encounters the undisturbed stony soil and preliminarily breaks it up ahead of the cutters as the powered vehicle moves forwardly; and means for rotatably driving said cutting head about said longitudinal axis whereby said cutters further break up the soil and mound it upwardly within the trench as said vehicle moves forwardly.

5. Apparatus as defined in claim 4 wherein said cutting head is of frusto-conical configuration.

6. Apparatus as defined in claim 5 wherein said rearward end of the carrier is mounted for rotation about a vertical axis with respect to said frame, and including means for oscillating said carrier about said vertical axis as said vehicle moves forwardly.

7. Apparatus as defined in claim 4 wherein said rearward end of the carrier is mounted for rotation about a vertical axis with respect to said frame, and including means for oscillating said carrier about said vertical axis as said vehicle moves forwardly.

8. Apparatus as defined in claim 4 wherein the radius of said helix decreases toward said forward end face of the cutting head.

* * * * *